United States Patent [19]

Miller et al.

[11] Patent Number: 5,006,861

[45] Date of Patent: Apr. 9, 1991

[54] ANTENNA

[75] Inventors: John E. Miller, Sunrise; Frank E. Lambrecht, Hollywood, both of Fla.

[73] Assignee: Motorola, Inc., Schaumburg, Ill.

[21] Appl. No.: 340,634

[22] Filed: Apr. 20, 1989

[51] Int. Cl.[5] ..... H01Q 1/36

[52] U.S. Cl. ..... 343/848; 343/895; 343/731

[58] Field of Search ..... 343/895, 846, 829, 848, 343/788, 867, 731

[56] References Cited

U.S. PATENT DOCUMENTS

| | | | |
|---|---|---|---|
| 2,945,227 | 7/1960 | Broussaud | 343/895 |
| 3,235,871 | 2/1966 | Smith et al. | 343/895 |
| 3,449,752 | 6/1969 | Spitz et al. | 343/895 |
| 4,495,503 | 1/1985 | Morman | 343/748 |
| 4,644,366 | 2/1987 | Scholz | 343/895 |

*Primary Examiner*—Michael C. Wimer

*Attorney, Agent, or Firm*—Thomas G. Berry; Robert S. Babayi

[57] ABSTRACT

An antenna comprises a conductive helix (10) positioned parallel to a ground plane (12). One end (14) of the helix is coupled to the ground plane (12), while the other end (16) is left open. Radio frequency signals (20) are fed (18) into the open end of the helix to excite the antenna and radiate the radio frequency signal.

8 Claims, 1 Drawing Sheet

ANTENNA

TECHNICAL FIELD

This invention relates generally to antennas, and more specifically to stub-fed antennas suitable to transmit or receive an information signal.

BACKGROUND ART

Designers of contemporary communication devices typically strive to minimize the physical size of the communication devices. However, some practical limitations continue to imped the miniaturization (size reduction) of communication devices. One such limitation comprises antenna size. Since antennas are typically one-quarter wavelength of a frequency of interest, antenna size is largely dictated by the operational frequency of the communication device. Moreover, the effectiveness of the antenna for transmitting (radiating) or receiving information is largely dependent upon the provision of a suitable group plane. Compromising the ground plane to reduce size usually reduces the operational performance of the communication device. Accordingly, a need exists for a small, yet effective, antenna.

SUMMARY OF THE INVENTION

Accordingly, it is an object of the present invention to provide an antenna suitable for use in contemporary communication devices.

Briefly, according to the invention, an antenna comprises a conductive helix positioned parallel to a ground plane. One end of the helix is coupled to the ground plane, while the other end is left open. Radio frequency signals are fed into the open end of the helix to excite the antenna and radiate the radio frequency signal.

BRIEF DESCRIPTION OF THE DRAWINGS

The drawing FIG. 2 illustrates an antenna in accordance with the present invention.

DETAILED DESCRIPTION OF THE PREFERRED EMBODIMENT

Figure 1:
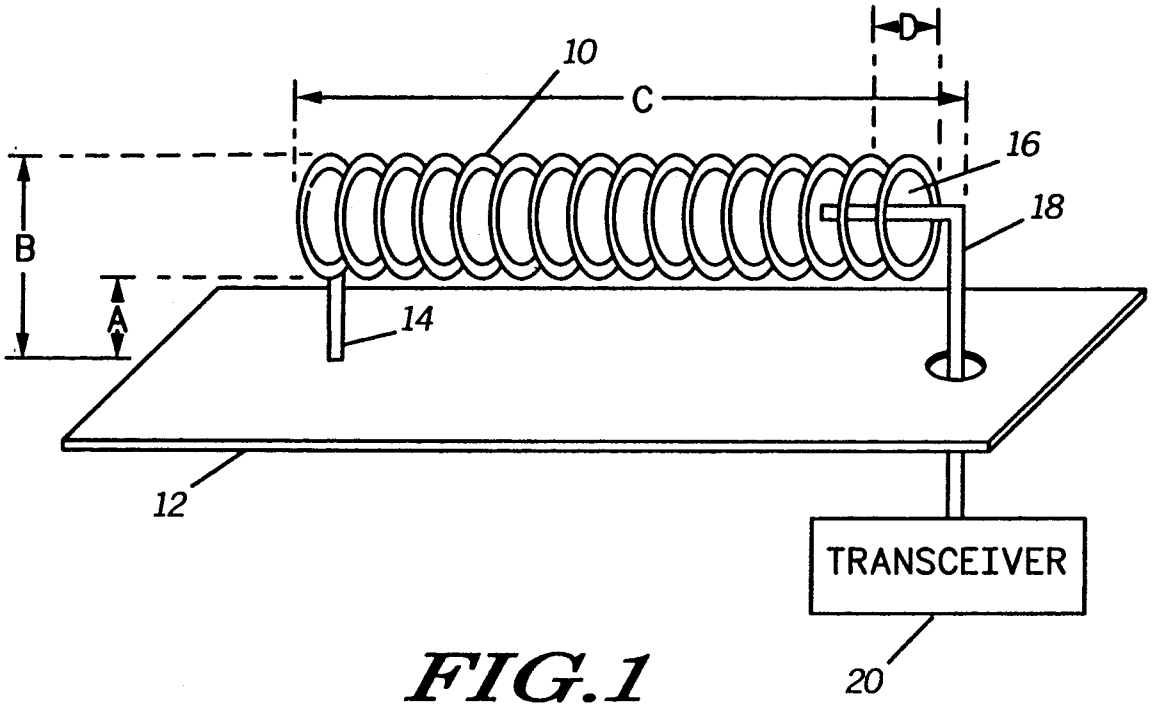

Referring to the drawing FIG. 1, an antenna in accordance with the present invention will be seen to comprise a conductive helix 10, which may comprise a coil of wire. As shown, the conductive helix 10 has been arranged parallel to a ground plane 12. One end (14) of the helix 10 is coupled to the ground plane 12 so as to effectively short the helix, while the other end (16) remains an open circuit and free from electrical connections.

To excite the antenna a stub 18 is positioned partly inside the helix at its open end (16), so as to electromagnetically couple a radio frequency (RF) signal provided by a RF source, which may comprise an RF amplifier from a transceiver 20 or other communication device. The stub 18 does not physically contract the helix, but rather, remains partially positioned within the helix. Thus, RF energy is electromagnetically coupled to the helix from the stub 18 to excite the antenna, which radiates (transmits) the RF signal.

To receive, an information signal is electromagnetically coupled from the helix 10 to the stub 18 which provides the received signal to the transceiver 20 (or optionally a receiver) for processing.

The dimensions of the conductive helix will, of course, vary depending upon the frequency of interest in any particular implementation. For 450 MHz, however, approximate dimensions are listed below in Table 1.

TABLE 1

| | |
|---|---|
| Dimension A | 0.05 in. (0.127 cm.) |
| Dimension B | 0.45 in. (1.143 cm.) |
| Dimension C | 1.30 in. (3.302 cm.) |
| Dimension D | 0.40 in. (1.016 cm.) |

In summary, the present invention comprises an antenna consisting of a helix of conductive element 10 positioned parallel to a ground plane 12. One end (14) of the helix 14 is coupled to the ground plane, while the other (16) is an open circuit. Radio frequency signals from an RF signal source 20 are fed (18) into the open circuit end 16 of the helix 10 to excite the antenna and radiate the radio frequency signal.

What is claimed is:

1. An antenna, comprising:

a conductive helix having first and second ends, said first end being shorted to a ground plane and said second end being open and free from electrical connections;

an open stub positioned partially within said second end of said conductive helix for receiving a radio frequency signal, and for electromagnetically coupling said radio frequency signal into said second end of said conductive helix.

2. The antenna of claim 1, including a radio frequency signal source for providing said radio frequency signal.

3. The antenna of claim 2, wherein said radio frequency signal source comprises a radio frequency power amplifier.

4. An antenna, comprising:

a conductive helix having first and second ends, said first end being shorted to a ground plane and said second end being open and free from electrical connections;

an open stub positioned partially within said second end of said conductive helix for receiving a radio frequency signal being electromagnetically coupled from said second end of said conductive helix.

5. An antenna, comprising:

a conductive helix being constructed and arranged parallel to a conductive ground plane, said conductive helix having a first end shorted to said ground plane and a second end being open and free from electrical connections;

an open stub positioned partially within said second end of said conductive helix for receiving a radio frequency signal being electromagnetically coupled from said second end of said conductive helix.

6. An antenna, comprising:

a conductive helix being constructed and arranged parallel to a conductive ground plane, said conductive helix having a first end shorted to said ground plane and a second end being open and free from electrical connections;

an open stub positioned partially within said second end of said conductive helix for receiving a radio frequency signal, and for electromagnetically coupling said radio frequency signal into said second end of said conductive helix so as to radiate said radio frequency signal.

7. The antenna of claim 6, wherein said conductive helix is laterally positioned so as to be parallel with said ground plane.

8. An antenna, comprising:

a conductive helix being constructed and arranged parallel to a ground plane, said conductive helix having a first end shorted to said ground plane and a second end being open and free from electrical connections;

an open stub positioned partially within said second end of said conductive helix for exciting said conductive helix by providing a radio frequency signal into said second end of said conductive helix.

* * * * *